US012590408B2

(12) United States Patent
Nevala et al.

(10) Patent No.: US 12,590,408 B2
(45) Date of Patent: Mar. 31, 2026

(54) WASHING UNIT, PLANAR WASHING MACHINE AND METHOD

(71) Applicant: 24 Pesula Oy, Kokkola (FI)

(72) Inventors: Jukka Nevala, Kokkola (FI); Veli-Pekka Nevala, Kokkola (FI)

(73) Assignee: 24 PESULA OY, Kokkola (FI)

( * ) Notice: Subject to any disclaimer, the term of this patent is extended or adjusted under 35 U.S.C. 154(b) by 373 days.

(21) Appl. No.: 17/637,212

(22) PCT Filed: Aug. 24, 2020

(86) PCT No.: PCT/FI2020/050546

§ 371 (c)(1),
(2) Date: Feb. 22, 2022

(87) PCT Pub. No.: WO2021/038128

PCT Pub. Date: Mar. 4, 2021

(65) Prior Publication Data

US 2022/0298723 A1 Sep. 22, 2022

(30) Foreign Application Priority Data

Aug. 27, 2019 (FI) ..... 20195704

(51) Int. Cl.

| | |
|---|---|
| ***D06G 1/00*** | (2006.01) |
| ***D06F 11/00*** | (2006.01) |
| ***D06F 17/04*** | (2006.01) |

(52) U.S. Cl.

CPC ..... *D06G 1/00* (2013.01); *D06F 11/00* (2013.01); *D06F 17/04* (2013.01)

(58) Field of Classification Search

None

See application file for complete search history.

(56) References Cited

U.S. PATENT DOCUMENTS 1,688,508 A * 10/1928 Shaw ..... D06F 31/00 68/94
4,182,001 A * 1/1980 Krause ..... A47L 11/4088 15/385
4,692,959 A 9/1987 Monson (Continued)

FOREIGN PATENT DOCUMENTS

CN 108209713 A 6/2018
DE 19505666 A1 * 8/1996 ..... B08B 1/02

(Continued)

OTHER PUBLICATIONS

Search Report of Finnish Patent Application 20195704, Filing Date Aug. 27, 2019; Date of Mailing Dec. 13, 2019, 2 pages.

(Continued)

*Primary Examiner* — Omair Chaudhri

(74) *Attorney, Agent, or Firm* — CANTOR COLBURN LLP

(57) ABSTRACT

A washing unit, planar washing machine and method for washing planar textile products. The washing unit (WU) comprises at least two rotating suction heads (13) and at least one washing nozzle (14), which is located between the suction heads. The washing unit is moved (A) in a reciprocating manner in a transverse direction (x) relative to a feed direction (y) of textile product (23) during washing process.

9 Claims, 3 Drawing Sheets

(56) References Cited

U.S. PATENT DOCUMENTS

| | | | | |
|---|---|---|---|---|
| 5,463,791 | A * | 11/1995 | Roden | A47L 11/4077 15/385 |
| 2011/0023322 | A1* | 2/2011 | Zinke | D06F 58/50 34/132 |
| 2016/0367100 | A1* | 12/2016 | Tran | A47L 11/4044 |
| 2017/0049285 | A1 | 2/2017 | Studebaker et al. | |
| 2019/0014964 | A1* | 1/2019 | Velasquez | A47L 9/242 |
| 2019/0082925 | A1* | 3/2019 | Conrad | A47L 5/36 |
| 2022/0248921 | A1* | 8/2022 | Tsuchida | A47L 9/2884 |
| 2023/0147103 | A1* | 5/2023 | Song | A47L 11/4088 15/322 |
| 2023/0248196 | A1* | 8/2023 | Song | A47L 9/0411 15/322 |

FOREIGN PATENT DOCUMENTS

| | | | | |
|---|---|---|---|---|
| DE | 102005025592 | B3 * | 10/2006 | D06G 1/00 |
| DE | 102008048666 | A1 * | 3/2010 | B08B 1/02 |
| EP | 1065011 | A1 * | 1/2001 | B08B 5/04 |
| EP | 3315645 | A1 * | 5/2018 | D06F 11/00 |
| FR | 2642334 | A1 * | 8/1990 | |
| KR | 20160150433 | A | 12/2016 | |

OTHER PUBLICATIONS

Office Action issued by the China State IP Office dated Jul. 15, 2024 in Chinese Application No. 2020800607075, English translation provided, 19 pages.

* cited by examiner

WASHING UNIT, PLANAR WASHING MACHINE AND METHOD

CROSS REFERENCE TO RELATED APPLICATIONS

This application is a National Stage application of PCT/FI2020/050546, filed Aug. 24, 2020, which claims the benefit of Finnish Application No. 20195704 filed Aug. 27, 2019, both of which are incorporated by reference in their entirety herein.

BACKGROUND OF THE INVENTION

The invention relates to a washing unit for washing rugs and carpets.

The invention further relates to a planar washing machine and to a method of washing rugs and carpets.

The field of the invention is defined more specifically in the preambles of the independent claims.

Planar washing machines have been developed for washing different kind of planar separate textile products. Such machines are used for example in self-service laundromats. The present solutions have shown some disadvantages in their washing units.

BRIEF DESCRIPTION OF THE INVENTION

An object of the invention is to provide a novel and improved washing unit and solution for washing separate textile products in a planar washing machine.

The washing unit according to the invention is characterized by the characterizing features of the first independent apparatus claim.

The planar washing machine according to the invention is characterized by the characterizing features of the second independent apparatus claim.

The method according to the invention is characterized by the characterizing features of the independent method claim.

An idea of the disclosed solution is that a washing machine intended for washing separate planar textile products is provided with one or more washing units. The washing unit comprises a frame, at least two rotating suction heads and at least one washing nozzle for feeding washing liquid to the textile product being washed. The mentioned washing nozzle is located between the mentioned rotating suction heads. In other words, only the suction heads are rotated and the one or more washing nozzles are immovable relative to the frame of the washing unit.

An advantage of the disclosed solution is that when the suction heads are arranged separately relative to the washing nozzles, the structure of the washing unit may be simple and robust. For example, there is no need to arrange rotating feed connections to the washing fluid conduits and the suction heads may be designed solely for the suction purpose.

Let it be mentioned that the term "washing fluid" may also refer to a rinsing fluid or agent. This way the washing nozzles may spray not only the washing agent but also the rinsing fluid towards the textile product being washed. Then the suction head may remove both the washing and rinsing agent from the textile product.

According to an embodiment, the washing unit is intended for washing rugs and carpets. The rug is a separate piece of thick cloth which is not fixed to a floor. In some instances the term "carpet" is also used for such separate textile floor coverings.

According to an embodiment, the washing nozzle is located at a distance from the front end or face of the suction head facing towards the textile product being washed. In other words, the washing liquid is fed from a distance towards the textile product and the suction head is in physical contact with the textile product.

According to an embodiment, the mentioned at least two suction heads are arranged to be rotated into opposite directions relative to each other. When the two adjacent suction heads are rotated into opposite directions, then their rotating forces directed to the textile product being washed cancel each other and no wrinkles are formed. The opposing rotating suction heads may also facilitate the cleaning process, and further, entanglement of long hair and yarns around the rotating components may also be avoided.

According to an embodiment, the washing unit comprises at least two washing rows, wherein each washing row comprises two suction heads and at least one washing nozzle between the suctions heads. Then the washing unit comprises at least four suction heads and at least two washing nozzles. Number of washing rows may also be more than two, if needed. An advantage of this embodiment is that the washing unit covers a wider range and washing capacity may be increased.

According to an embodiment, the suction head comprises a face, which is intended to be directed towards the textile product being washed. The face of the suction head is round and comprises a narrow longitudinal suction opening passing transversally through a rotation axle of the suction head. The narrow longitudinal suction opening intensifies the suction effect and may cover the entire suction head when being rotated.

According to an embodiment, the above mentioned suction opening of the face of the suction head comprises a central part and two transverse branches which are located at distal ends of the central part and are facing into opposite directions relative to each other. According to practical tests the disclosed specific shape of the suction opening is found to be effective.

According to an embodiment, the suction head is configured to be rotated so that the mentioned branches are directed towards the rotation direction of the suction head. The aim of the braches is to intensify the suction and to prevent splashing of the washing fluid.

According to an embodiment, the washing unit is provided with a frequency converted electric motor for driving the rotating suction heads.

According to an embodiment, rotation speed and torque of the frequency converted electric motor can be controlled steplessly. Further, there is no need for separate gearing, whereby weight of the washing system may be reasonable and the structure may be simple.

According to an embodiment, the rotation movement generated by the electric motor is transmitted to all suction heads by means of a power transmission based on a toothed belt.

According to an embodiment, the washing unit is provided with an electric motor for providing driving of the rotating suction heads in constant speed. Thus, suitable rotation speed may be determined beforehand. The rotation speed may be selected in relation to the feed speed of the textile product and the movement speed of the washing unit, for example.

According to an embodiment, the washing unit comprises bearing means for coupling it to a linear guide surface of the washing machine and to thereby allow the washing unit to be moved linearly under control of the linear guide surface.

According to an embodiment, an elongated transverse guide bar is serving as the linear guide surface.

According to an embodiment, the frame of the washing unit comprises at least two rollers on a side facing towards the textile product and configured to be set against the textile product during the washing process.

According to an embodiment, the washing unit is provided with at least two sensing devices for sensing longitudinal edges of the textile product being washed. The sensing device may be in physical contact with the textile product, or alternatively it may detect the edge by using remote sensing techniques. The remote sensing system may comprise ultrasonic sensors or laser sensors, for example.

According to an embodiment, the washing nozzle is mounted immovably relative to the frame of the washing unit. This way structure and mounting of the washing nozzle may be simple and durable.

According to an embodiment, the washing nozzle may be mounted to the frame and it may be located at a distance from the front faces of the suction heads. An advantage of this embodiment is that the washing nozzle is well protected when being at an offset from the textile product being washed. Furthermore, spreading of the washing spray or fan may be improved.

According to an embodiment, when there are suction heads arranged in two or more rows, then the several washing nozzles are mounted to gaps remaining between the adjacent suction heads. The washing nozzles are then well protected and the washing jets are effectively directed towards the textile product being washed.

According to an embodiment, the washing nozzle is configured to produce a narrow fan-like washing agent jet, which is directed against the textile product. The fan-like jet has wide coverage and still the washing nozzle may be simple.

According to an embodiment, width of the above mentioned fan-like washing agent jet may correspond to a diameter of the rotating suction head. Then the washing agent jet may cover the entire width of the washing unit.

According to an embodiment, when there are two or more rows of the suction heads, then the fan-like washing agent jets may be configured to partly overlap. This way the fan-like jets cover together a wide range.

According to an embodiment, the solution relates to a planar washing machine for washing separate planar textile products. The washing machine may comprise: a standing body configured to be mounted on a floor; a feed opening for feeding the textile product into the washing machine; transfer means for transferring the textile product in the washing machine in a feed direction; at least one washing unit for washing the textile product inside the washing machine; and wherein the washing unit is configured to be driven in a reciprocating manner in a transverse direction relative to the feed direction, whereby the washing unit is moved between longitudinal edges of the textile product. In other words, the textile product is fed during a washing cycle in the feed direction relative to the washing unit by means of the transfer means. Thus, the washing unit is not moved in the feed direction. However, the washing unit is driven perpendicularly relative to the feed direction. Further, the washing unit is as it is disclosed above in this document.

According to an embodiment, the washing machine comprises at least one guide surface direction of which is perpendicular to the feed direction and the washing unit is provided with bearings for supporting the washing unit to the guide surface.

According to an embodiment, the washing unit comprises two rows of suction heads transverse to the feed direction. Each row comprises adjacent two suction heads, whereby total number of rotating suction heads is four. Between the adjacent two suction heads of each row is a gap provided with at least one washing nozzle. Furthermore, the adjacent suction heads of each row are rotated into opposite directions relative to each other so that their direction of rotation is towards the mentioned gap.

According to an embodiment, the solution relates to a method of washing separate planar textile products with a planar washing machine. The method comprises: feeding an end of textile product into a feed opening of the washing machine; feeding the textile product in a feed direction with transfer means; washing the textile product by means of at least washing unit and moving the washing unit in a transverse direction relative to the feed direction during the washing; directing a washing fluid jet from at least one washing nozzle of the washing unit towards a surface of the textile product; and directing suction from at least one rotating suction head to the surface of the textile product in order to remove moisture form the textile product. The method further comprises providing the washing unit with at least two separate rotating suction heads and directing the washing fluid jet from at least one non-rotating separate washing nozzle which is located in a gap between adjacent rotating suction heads.

According to an embodiment, the disclosed method comprises rotating the adjacent suction heads into opposite directions relative to each other and arranging faces of the rotating suction heads into physical contact with the textile product in order to intensify the washing.

According to an embodiment, the disclosed method comprises rotating the adjacent suction heads into opposite directions relative to each other and providing faces of the suction heads with shaped suction openings in order to prevent splashing of the washing fluid.

The above disclosed embodiments may be combined in order to form suitable solutions having those of the above features that are needed.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF SOME EMBODIMENTS

Figure 1:
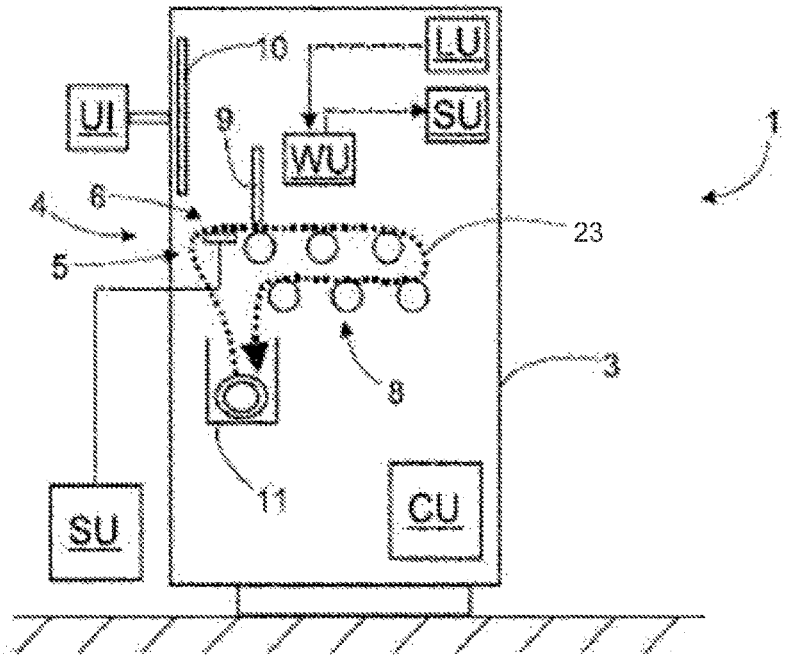
FIG. 1 is a schematic side view of a planar washing machine mounted on a floor.

FIG. 1 shows a planar washing machine 1 for washing planar textile products 23 such as rugs or similar furnishing textiles. The washing machine 1 comprises a body 3. The textile product 23 may be fed into the washing machine 1 through a feed opening 4. The actual washing may be performed by means of a washing unit WU. The washing unit WU may comprise one or more washing nozzles and two or more suction heads. Washing agent or washing liquid is fed with high pressure from a washing liquid unit LU, and a drying suction may be formed with a suction unit or source SU. The operation of the washing machine 1 may be controlled by a control unit CU. The control unit CU may automatically control the suction of a holding device 6, hatch 10, feeding or transfer means 8, washing unit WU and generally the entire work cycle of the washing machine 1. The washing machine 1 washes the rug with the aid of one or more washing agent jets and two or more rotating suction heads. The washing agent used in the washing is water to which washing agent may have been mixed. Further, the washing machine 1 sucks off the water left in the rug after the washing, drying the rug so that when the rug is taken out of the washing machine, no water will run out of it and it will dry fast. The disclosed washing machine 1 may be installed in a launderette where the customers themselves use the washing machine.

Figure 2:
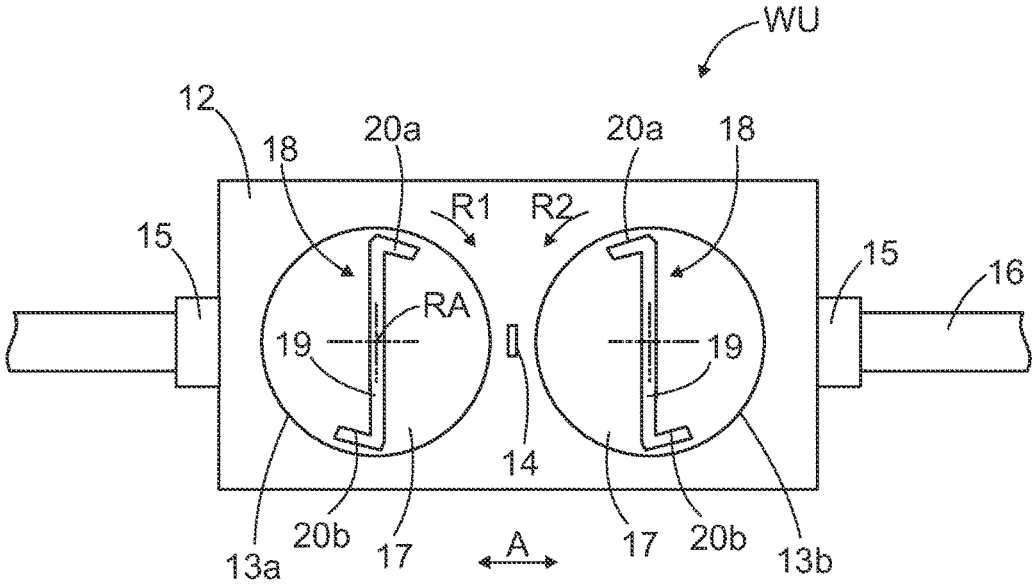
FIG. 2 is a schematic view of a washing unit seen from the side facing towards the textile product being washed.

FIG. 2 discloses a washing unit WU comprising a frame 12 and two rotating suction heads 13. A washing nozzle 14 is located between the suction heads 13*a*, 13*b*. As indicated in the FIG. 2 the washing unit WU is provided with bearings 15 so that is can be moved A along a guide surface 16. Further, the suction heads 13*a*, 13*b* may be rotated into opposite directions R1 and R2. The suction heads 13 are rotated R relative to rotation axles RA of the suction heads 13. The suction head 13 comprises a face 17 provided with a suction opening 18. The suction opening 18 may comprise a longitudinal narrow central part 19 and two transverse branches 20*a*, 20*b* at distal ends of the suction opening 18. The braches 20 may be facing into opposite directions.

Figure 3:
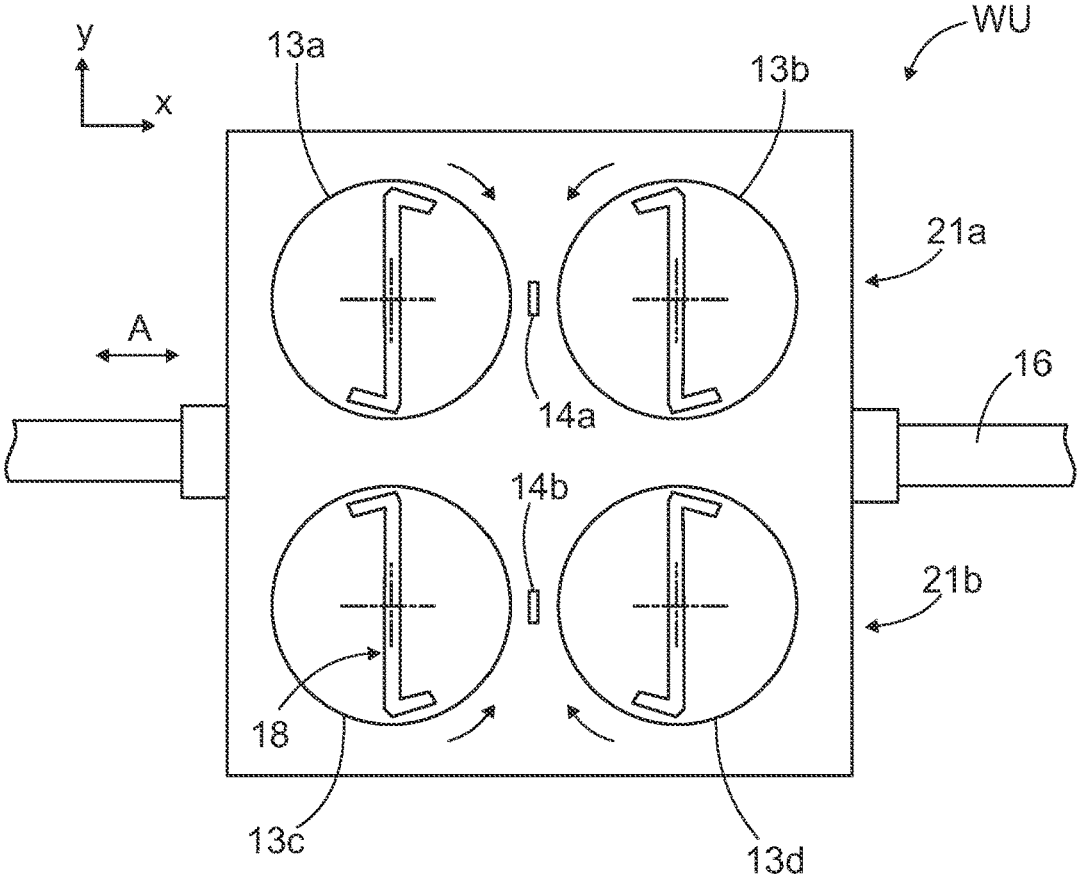
FIG. 3 is a schematic view of a washing unit comprising suction units and washing nozzles in two parallel rows.

FIG. 3 discloses a washing unit WU comprising four rotating suction heads 13*a*-13*d*, and two nozzles 14*a* and 14*b* for feeding washing and rinsing fluids. The suction heads 13*a* and 13*b* are arranged to form a first row 21*a* and the suctions heads 13*c* and 13*d* are arranged to form a second row 21*b*. This way, the washing unit is wider in a feed direction y. Further, the suction heads 13 of both rows 21 are rotated into opposite directions and the all comprise narrow suction openings 18.

Figure 4:
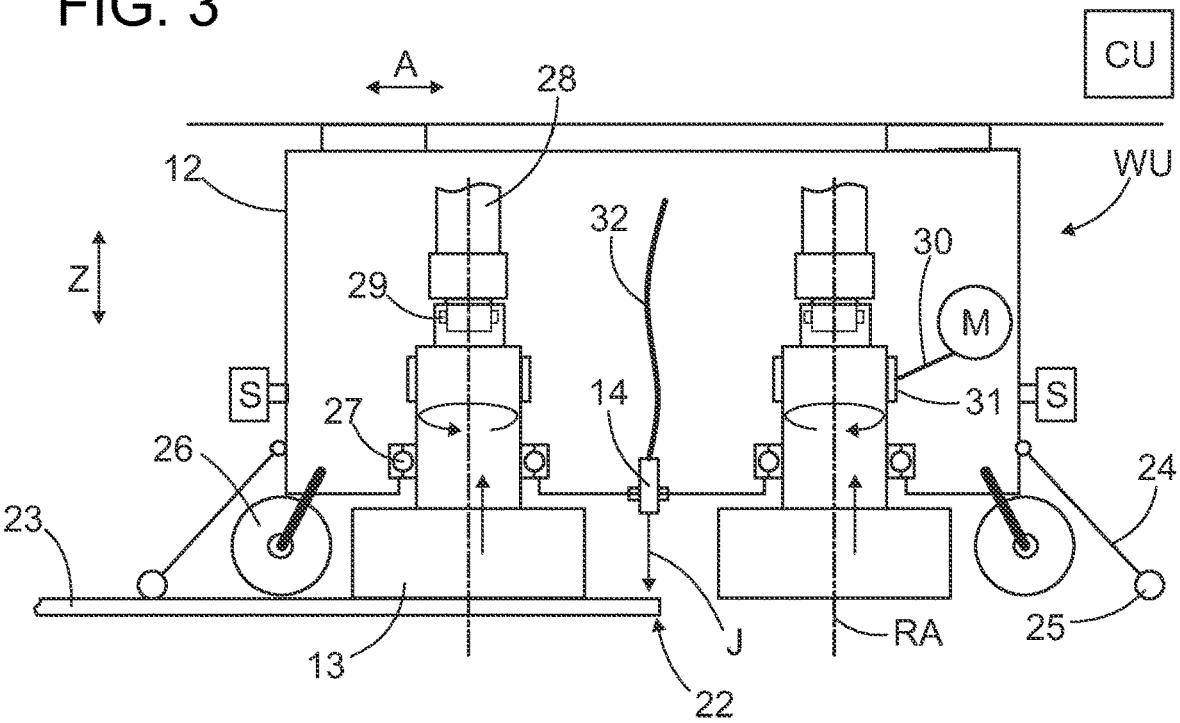
FIG. 4 is a schematic side view of a washing unit positioned at an edge of a planar textile product being washed.

FIG. 4 discloses a washing unit WU which is moved transversally to its right most extreme position where a washing nozzle 14 is at a longitudinal edge 22 of a textile product 23. The edges 22 can detected by means of a sensing device 24 and a control unit CU may control the movement A of the washing unit WU in response to received detection data. The sensing device 24 may comprise a contact element 25 for sensing the edge 22, or alternatively, there may be contactless sensors at opposite ends of the washing unit WU. A frame 12 may also be provided with rollers 26 facing towards the textile product 23 and configured to be set against the textile product 23 when the washing unit WU is lowered Z to the operational position. Suction heads 13 are supported to the frame 12 by means of bearings 27 and their upper parts are connected to suction conduits 28 for leading suction from a suction unit. There may be a rotating connection and seals 29 between the suction conduit 28 and the suction head 13. The suction heads 13 may be rotated with one common motor M. The motor M may be an electrical motor connected to the suction heads 13 by means of transmission means 30, such as toothed belt. The suction heads 13 may then be provided with corresponding toothed parts 31 on their outer surfaces. The washing nozzle 14 is located between the suction heads 13 and are positioned at a vertical distance from the textile product 23 and a face surface of the suction heads 13. The washing nozzle 14 is in fluid connection with a washing fluid conduit 32. The washing nozzle 14 may form a flushing jet J which may have fan-like configuration.

Figure 5:
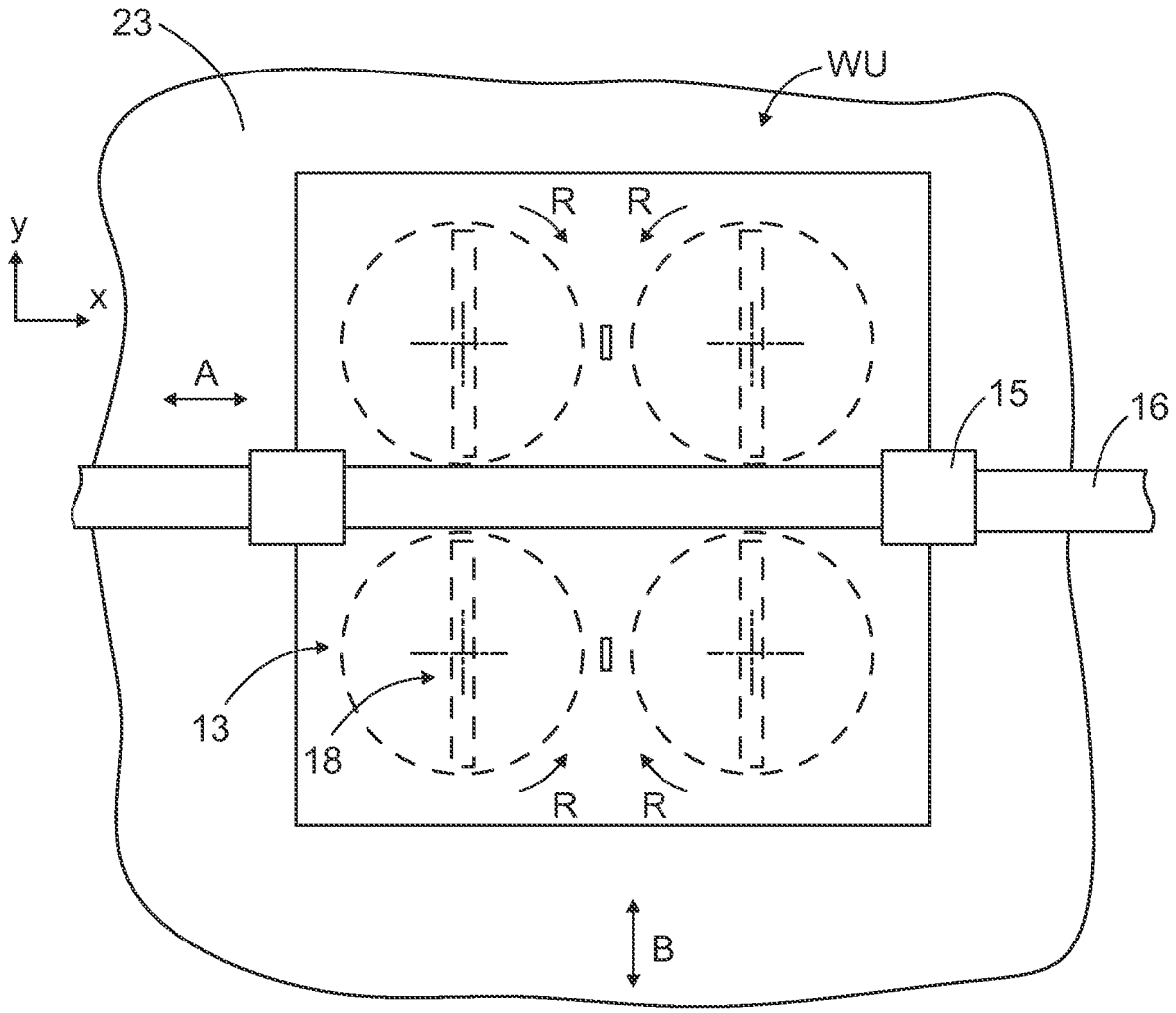
FIG. 5 is a highly simplified top view of a washing unit supported movably to a transverse guide bar.

FIG. 5 discloses a washing unit WU movable A transversally x relative to a textile product 23 which is movable B in a feed direction y inside a planar washing machine. Rotating suction heads 13 are shown with broken lines. Suction openings 18 of the suction heads 13 may have slit-like configuration. Alternatively, the washing unit WU may comprise three or even more washing rows and dedicated washing nozzles between the suction heads. However, number of the washing nozzles may be greater as the number of the rows. The suction heads may be arranged to form a suction pattern 1*2, 2*2, 3*2 or 4*2 for example, wherein the first numeral indicates the number of the rows and the second numeral indicates that each row comprises two successive suctions heads.

The drawings and the related description are only intended to illustrate the idea of the invention. In its details, the invention may vary within the scope of the claims.

The invention claimed is:

1. A planar washing machine (1) for washing separate planar textile products (23), wherein the washing machine (1) comprises:

a standing body (3) configured to be mounted on a floor;

a feed opening (4) for feeding the textile product (23) into the washing machine (1);

transfer means (8) for transferring (B) the textile product (23) in the washing machine (1) in a feed direction (y);

at least one washing unit (WU) for washing the textile product (23) inside the washing machine (1);

and wherein the at least one washing unit (WU) is configured to be driven in a reciprocating manner in a transverse direction (x) relative to the feed direction (y), whereby the at least one washing unit (WU) is moved (A) between longitudinal edges (22) of the textile product (23);

wherein the washing unit (WU) comprises a frame (12), at least two rotating suction heads (13, 13*a*-13*d*) and at least one washing nozzle (14) for feeding washing liquid and being located between the at least two rotating suction heads (13);

and the at least one washing nozzle (14, 14*a*, 14*b*) is immovable relative to the frame (12) of the washing unit (WU);

the washing unit (WU) comprises two rows (21*a*, 21*b*) of rotating suction heads (13) transverse to the feed direction (y), each row (21) comprising two rotating suction heads (13) that are adjacent to one another, whereby a total number of rotating suction heads is four;

between the two rotating suction heads (13) of each row (21) that are adjacent to one another is a gap provided with at least one washing nozzle (14); and the rotating suction heads (13) of each row (21) that are adjacent to one another are rotated (R) into opposite directions relative to each other so that their direction of rotation is towards the gap.

2. The planar washing machine as claimed in claim 1, wherein each of the at least two rotating suction heads (13) comprises a face (17) directed towards the textile product (23) being washed;

the face (17) is round and comprises a narrow longitudinal suction opening (18) passing transversally through a rotation axle (RA) of the rotating suction head (13).

3. The planar washing machine as claimed in claim 2, wherein the suction opening (18) of the face (17) of the rotating suction head (13) comprises a central part (19) and two transverse branches (20*a*, 20*b*) which are located at distal ends of the central part (19) and are facing into opposite directions relative to each other.

4. The planar washing machine as claimed in claim 1, wherein the at least one washing unit (WU) is provided with an electric motor (M) for driving the at least two rotating suction heads (13).

5. The planar washing machine as claimed in claim 1, wherein the at least one washing unit (WU) comprises bearing means (15) for coupling it to a linear guide surface (16) of the washing machine (1) and to thereby allow the at least one washing unit (WU) to be moved (A) linearly under control of the linear guide surface (16).

6. The planar washing machine as claimed in claim 1, wherein each of the at least one washing nozzle(s) (14) is mounted immovably relative to the frame (12) of the at least one washing unit (WU).

7. The planar washing machine as claimed in claim 1, wherein each of the at least one washing nozzle(s) (14) is configured to produce a narrow fan-like washing agent jet (J), which is directed against the textile product (23).

8. The planar washing machine as claimed in claim 1, wherein the washing machine (1) comprises at least one guide surface (16), a direction of which is perpendicular to the feed direction (y) and the at least one washing unit (WU) is provided with bearings (15) for supporting the at least one washing unit (WU) to the guide surface (16).

9. A washing unit (WU) for a planar washing machine (1) comprising:

a frame (12);

and at least one washing nozzle (14) for feeding washing liquid;

wherein:

the washing unit (WU) comprises at least two rotating suction heads (13, 13*a*-13*d*); the at least one washing nozzle (14, 14*a*, 14*b*) is located between the at least two rotating suction heads (13);

the at least one washing nozzle (14, 14*a*, 14*b*) is immovable relative to the frame (12) of the washing unit (WU), the washing unit (WU) comprises two rows (21*a*, 21*b*) of rotating suction heads (13) transverse to the feed direction (y), each row (21) comprising two rotating suction heads (13) that are adjacent to one another, whereby a total number of rotating suction heads is four;

between the two rotating suction heads (13) of each row (21) that are adjacent to one another is a gap provided with at least one washing nozzle (14); and the rotating suction heads (13) of each row (21) that are adjacent to one another are rotated (R) into opposite directions relative to each other so that their direction of rotation is towards the gap.

* * * * *